US005471709A

United States Patent [19]

Lanzani

[11] Patent Number: 5,471,709

[45] Date of Patent: Dec. 5, 1995

[54] BUILT-IN ELECTRICAL APPLIANCES, REFRIGERATORS IN PARTICULAR

[75] Inventor: Oresta Lanzani, Via Rosselli 1, Bagnolo Mella (Brescia), Italy

[73] Assignees: Oreste Lanzani; Luciano Manesta; Angelo Bertasio, all of Brescia, Italy; a part interest

[21] Appl. No.: 181,612

[22] Filed: Jan. 13, 1994

[30] Foreign Application Priority Data

Jan. 13, 1993 [IT] Italy ..... MI93A0027

[51] Int. Cl.[6] ..... E05D 7/04; E05F 1/14

[52] U.S. Cl. ..... 16/238; 16/243; 16/245; 16/288; 16/302

[58] Field of Search ..... 16/238, 243, 245, 16/287, 288, 294, 302, 370

[56] References Cited

U.S. PATENT DOCUMENTS

| | | | |
|---|---|---|---|
| 3,425,766 | 2/1969 | Crisera | 16/370 |
| 4,157,599 | 6/1979 | Holmes | 16/302 |
| 4,493,129 | 1/1985 | Grass | 16/238 |

FOREIGN PATENT DOCUMENTS

| | | | |
|---|---|---|---|
| 622541 | 6/1927 | France | 16/370 |
| 2530321 | 1/1977 | Germany | 16/302 |
| 2706821 | 8/1978 | Germany . | |
| 3019511 | 11/1981 | Germany | 16/302 |
| 181251 | 6/1922 | United Kingdom | 16/370 |

*Primary Examiner*—Lowell A. Larson
*Assistant Examiner*—Donald M. Gurley
*Attorney, Agent, or Firm*—McGlew and Tuttle

[57] ABSTRACT

A hinge (1) for a door (6) of an electrical appliance, (for example a refrigerator, for use in particular where the appliance is built in) to be covered with a facing panel (7) is provided with structure for adjusting the position of the panel on the door. The hinge includes a first support member (2) attached to the body (4) of the appliance, a second support member (5) attached to the door (6) and the facing panel (7) and first and second connecting bars (9, 10) connecting said first and second support members to form a hinged quadrilateral therewith. The second support member also includes adjustment structure ( 16, 17) enabling adjustment of the horizontal and vertical position of the panel (7) relative to the door (6). The adjustable structure may be detachable from the hinge.

8 Claims, 3 Drawing Sheets

BUILT-IN ELECTRICAL APPLIANCES, REFRIGERATORS IN PARTICULAR

FIELD OF THE INVENTION

This invention relates to a hinge for built-in electrical appliances, refrigerators in particular, for the attachment of at least one door, which is linked with a panel, to the body of the electrical appliance.

BACKGROUND OF THE INVENTION

In built-in electrical appliances, and in refrigerators in particular, when the front panel of the piece of furniture into which the refrigerator is built is opened (or closed) it is desirable that the refrigerator door should open (or close) at the same time, In order to resolve this problem it has been suggested that the two opposing sides of the panel and the refrigerator door should be connected by means of a slider and a guide which act together in such a way that when the panel is opened it causes the refrigerator door also to rotate, the panel and the door being hinged to the piece of furniture and the body of the refrigerator respectively in the normal way.

In this arrangement the connecting members between the panel and the door have to be adjusted frequently in order that the refrigerator door should shut properly. This adjustment is however quite difficult, and therefore it frequently happens that either the refrigerator door does not close properly or the panel is not flush with the other surfaces of the kitchen furniture when it is closed. Also, empty spaces have to be left both between the piece of furniture and the body of the refrigerator and between the panel and the refrigerator door in order to allow both the door and the panel to rotate simultaneously, In order to overcome these disadvantages it has been suggested that the panel and the refrigerator door should be rigidly connected.

This arrangement too has given rise to problems. In fact the panel has to project by a certain amount with respect to the refrigerator door so as to at least partly cover the visible edges of the sides of the item of furniture into which the refrigerator is built. This hinders opening of the refrigerator door, as the edges of the panel and the side, by coming into contact, prevent the door from being opened if it is hinged using a hinge of a conventional type.

In order to overcome this problem different special types of hinge, e.g. the type produced by Hettict and mounted on refrigerators manufactured by the largest manufacturers of domestic appliances (e.g. Baucknecht, Electrolux, Zanussi) have been constructed. Such hinges comprise two supporting members which are linked respectively to the body and the door of the refrigerator and are attached together and to the supporting members by means of four bars so as substantially to provide two quadrilaterals which are hinged on two sides and have a common hinge point.

When the door opens the aforesaid hinge first brings about limited rotation of the door with respect to the front of the refrigerator so that the panel moves away from the edge of the item of furniture into which the refrigerator is built, and then permits greater rotation of the door itself so that the door can open through ninety or more degrees.

The Hettict hinge is however difficult and complicated to manufacture. For example seven pins are required to connect together the individual parts, and this has an appreciable effect on the times and costs involved in production of the hinge. Also, because of play in the pine due to tolerance or resulting from wear or yielding under load, the hinge does not ensure optimum door closure.

A type of hinge in which the two supporting members are connected in the manner of a hinged quadrilateral with only two pins and a return spring is also known, and is described in e.g. patent DE-A-2706821. This type of hinge is generally small, unsuitable for refrigerator doors and is only used for furniture door panels.

SUMMARY AND OBJECT OF THE INVENTION

Against this background the object of this invention is to provide a hinge for the doors of built-in electrical appliances which overcomes the abovementioned disadvantages and which in particular is easy to manufacture, incorporates a small number of components and ensures reliable opening and closing of the door without interference between the door panel and the item of furniture into which the electrical appliance is built.

A further object is to provide a hinge which permits rapid and simple adjustment of the position of the panel with respect to the refrigerator door when the panel is attached thereto.

These and other objects which will be evident to those skilled in the art are accomplished by means of a hinge according to claim 1 which is intended for use in built-in electrical appliances with at least one door to which a panel is attached.

BRIEF DESCRIPTION OF THE DRAWINGS

For a better understanding of this invention the following drawings are appended, by way of non-limiting examples, in which.

DETAILED DESCRIPTION OF THE PREFERRED EMBODIMENT

Figure 1:
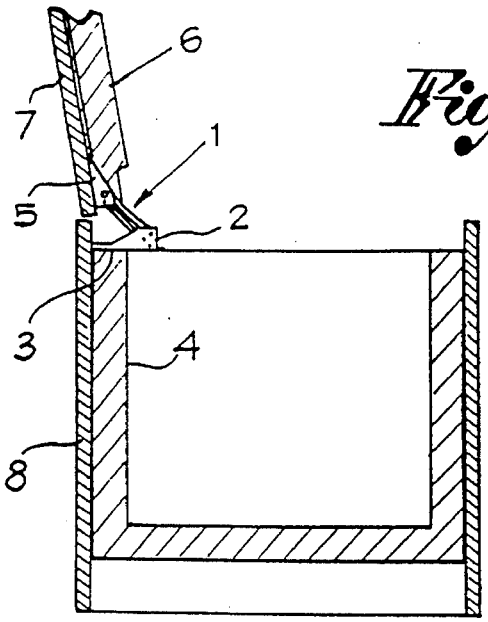
FIG. 1 is a view showing a built-in electrical domestic appliance equipped with a hinge according to the invention, with the door open, in transverse cross-section.

A hinge according to the invention, indicated as a whole by 1, comprises: a first supporting member 2 which can be attached to the front 3 (or to the upper and lower surfaces) of the body of a refrigerator 4 or other built-in electrical domestic appliance, and a second supporting member 5 which can be attached to both door 6 of the refrigerator and a panel 7 of an item of furniture 8 in order that the refrigerator can be built in.

Figure 2:
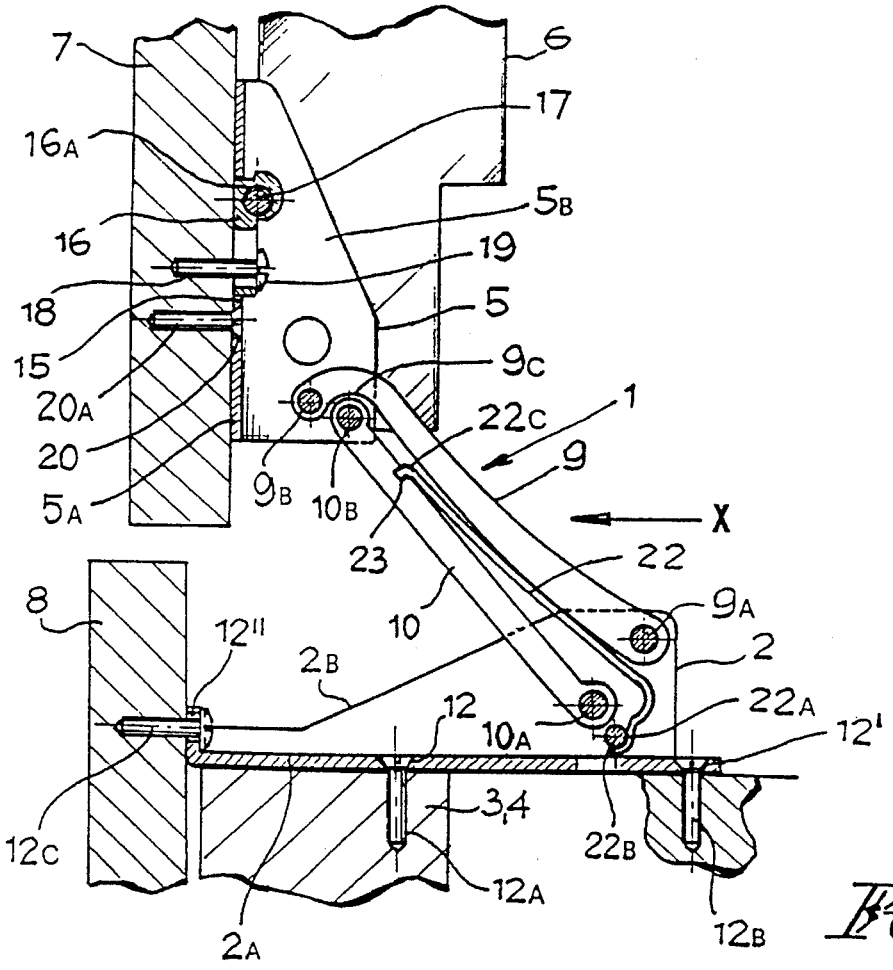
FIG. 2 is a magnified view in cross-section taken from above showing the hinge in the open position as in FIG. 1.

The two supporting members 2,5 are connected together—FIG. 2—by two connecting bars 9,10 which are hinged at 9A,9B 10A,10B respectively to the supporting members by means of pins 11 at the distal ends of the said members so as to form a hinged quadrilateral lying in a plane perpendicular to door 6.

The two supporting members 2,5 are channel shaped sections. Supporting member 2 which is attached to the front of the refrigerator has a hole or eyelet 12 for a screw 12A securing the hinge to the refrigerator in its base wall 2A (FIG. 2). A tongue with another hole or eyelet 12 for another securing screw 12B may be provided at one end of said base 2A. A tongue at right angles with a further hole or eyelet 12" for another screw 12C fixing the support to the side of item of furniture 8 enclosing the refrigerator may be provided at the opposite end. Member 2 may also be attached either to the top or the base of the refrigerator in a manner which is in itself known.

Figure 3:
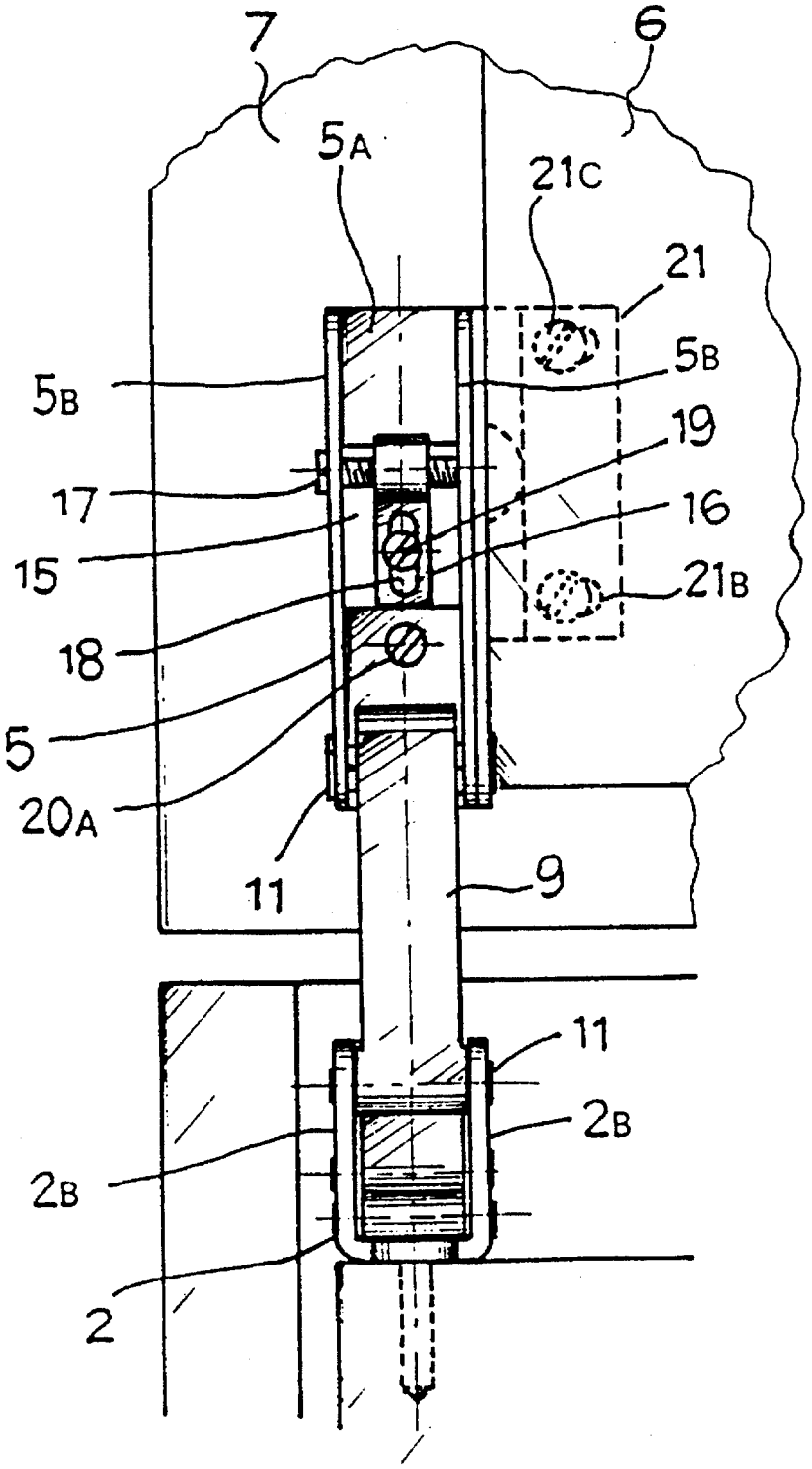
FIG. 3 is a side view of the open hinge along the arrow in FIG. 2.
Figure 4:
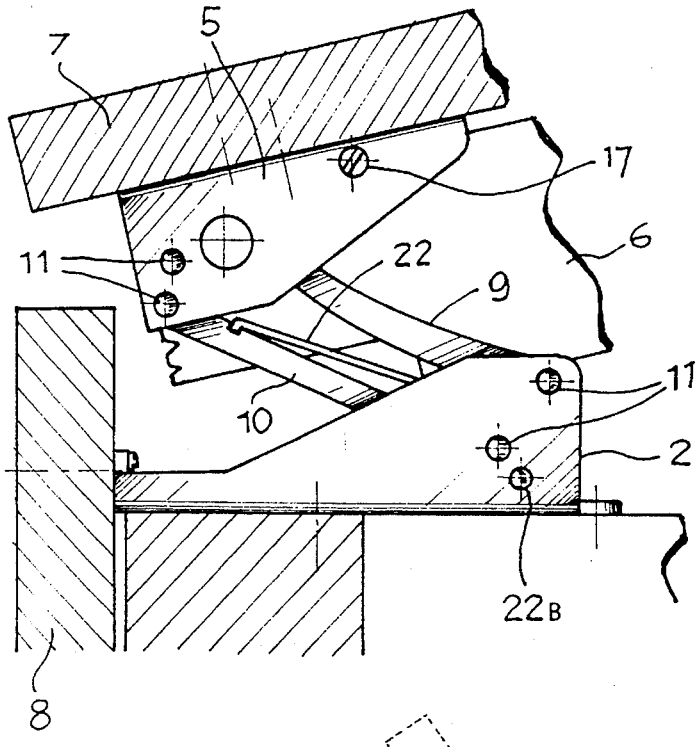
FIG. 4 is a partially sectional view showing the hinge in an intermediate position between the open and closed positions taken from above.

The other supporting member 5 for the hinge has a window 15 corresponding to its base wall 5A (FIGS. 2 and 3) in which an adjustment block 16, which can slide in a vertical direction, is provided.

This block has a threaded hole 16A through which may pass a screw 17 which can also rotate freely in two opposing holes provided in side walls 5B of the member itself so that the position of the block can be adjusted between side walls 5B, and an eyelet 18, which is perpendicular to hole 16A, housing a screw 19 for temporary attachment (as will be explained below) of panel 7 to door 6 of the refrigerator.

It should be emphasized that, advantageously, the two hinges normally used to attach the door to the refrigerator both have an adjustment block 16, but the block acts together with an adjustment screw 17 in only one of the two, while in the other lower hinge the screw is replaced by a pin on which the block can slide freely.

Also adjustment block 16 may be provided in a separable form so that it can be used by the fitter several times and the arrangement of adjustment screw 17 can be reversed so that they are always at the top if the hinge is turned the other way round. Also removal of the means of adjustment makes it possible for the holes to blanked off with plugs, thus improving the appearance of the hinge.

Wall 5A also includes a through hole 20 for a screw 20A for the permanent attachment of panel 7 to door 6.

In the example illustrated, a bracket 21 (FIG. 3) in which one limb projects on one side and has holes or eyelets 21B for the passage of fixing screws 21C can be attached to one of the side walls 5B of member 5.

The two connecting bars 9 and 10 are in the form of elongated plates of rectangular cross-section with hollow cylindrical seats at their ends to house hinge pins 11.

In order that the hinge should operate correctly, the distance E between the centers of the pins connecting the two bars 9,10 to member 2 is E=17.1±0.5 mm, the distance F between the centers of the pins connecting the two bars to member 5 is F=9.1±0.5 mm, the distance G between the centers of the end pins on connecting bar 9 is G=83.4±0.5, the distance H between the centers of the end pins on the other bar 10 is H=76.4±0.5 mm, or dimensions having the same proportions.

Of the two connecting bars, the outermost (9) with respect to the front 3 of refrigerator 4 has a curved portion 9C at the end which is hinged to supporting member 5 attached to door 6 with its concave side facing the other connecting bar 10. The curved portion is dimensioned so that the surface facing the other connecting bar 10 lies alongside the opposing cylindrical end of the latter when the hinge is opened through its maximum amount, thus permitting the hinge to open through at least ninety degrees.

The hinge also comprises a leaf spring 22, which is located between the two connecting bars, at one end of which there is a first curved portion 22A which engages and anchors on a fulcrum 22B which is attached to first supporting member 2 (FIG. 2), and at the other end a second bent portion 22C which can engage a slot 23 (FIG. 2) provided in lower connecting bar 10.

In use hinge 1 is attached to refrigerator 4 by securing the supporting member to the body of the refrigerator and item of furniture 8, if required.

With suitable arrangements the hinge can easily be attached to either the top or the base of the refrigerator, or to refrigerators with thicker walls.

In order to attach the door to the refrigerator use may e.g. be made of two hinges, one upper and one lower, the lower hinge advantageously having a block 16 for adjustment of the panel which is free to slide along a pin while the upper hinge has a block 16 which is engaged by adjustment screw 17.

Using screws 21C, supporting member 5 is then secured to door 6 of the refrigerator. It should be emphasized that hinges 1 are attached to the upper (or lower) free edge of the door in such a way that one of the side walls 5A of member 5 rests against the aforesaid edge and in such a way that wall 5A projects at the top (or at the bottom) so that panel 7 can be attached to said member 5 using screws 19 and 20A. In particular, the procedure for attaching the panel to supporting member 5 is as follows: the panel is attached to member 5 using screw 19; with simultaneous horizontal adjustment of the panel, screw 17 of the upper hinge is then adjusted to displace block 16 and adjust the height of the panel with respect to the door; finally the panel is securely fixed in the adjusted position using screw 20A.

For subsequent attachment of the panel to the door, a plate (which is not shown, as it is of conventional form) having a plurality of holes into which screws can be inserted to attach the plate to the door and the panel may e.g. be provided. As in the previous case, the plate, which is advantageously positioned on the edge of the door opposite the hinge, is attached to the door in such a way that part of the plate projects from the door and can therefore be attached to the panel once the position of the latter has been adjusted with respect to the door.

Figure 5:
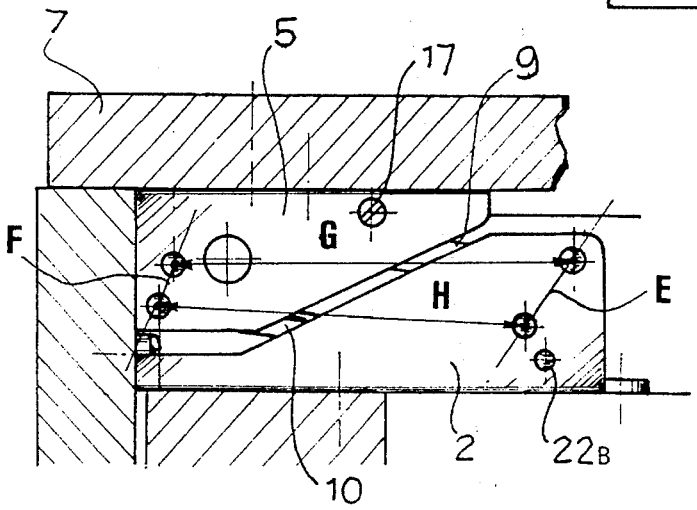
FIG. 5 is a partially sectional view showing the hinge in the closed position, again from above.

The opening and closing of the door is made easier as a result of spring 22. In particular the spring enables the hinge to adopt two positions which are in static equilibrium: a first position in which the door is closed (FIG. 5) and a second position in which the door is completely open (FIG. 1), in which the end of connecting bar 10 hinged to second supporting member 5 rests against the curved portion 9C of the other connecting bar 9.

It should also be noted that the existence of adjustment member 16,17 on member 5 appreciably assists positioning of panel 7 with respect to door 6, an operation which is generally difficult and time-consuming in known built-in electrical domestic appliances.

Figure 6:
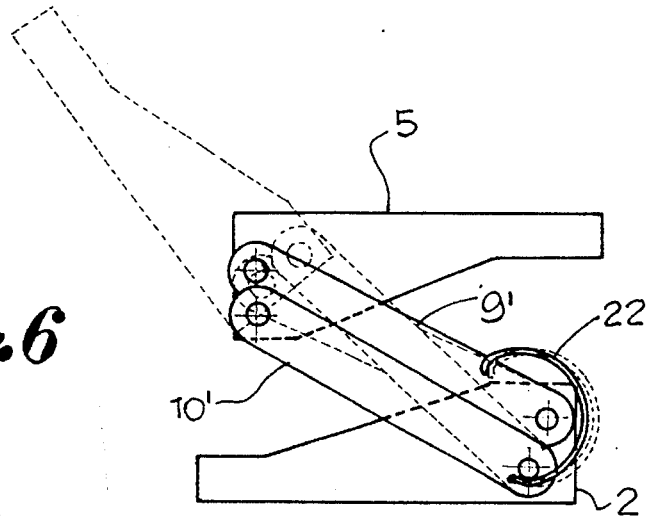
FIG. 6 is a view showing a variant of the hinge with connecting bars located in two different parallel planes.

FIG. 6 shows a diagram of a variant embodiment of the hinge in which the members which are common to the two embodiments are indicated using the same numbers.

In this variant connecting bars 9'–10', which are substantially flat, are hinged to supporting members 2 and 5 so that the planes in which the connecting bare lie are different and parallel to each other, so that the connecting bars do not interfere with each other as the door and the panel rotate. In particular it should be emphasized that in this variant the planes in which the connecting bare lie are also parallel to the side walls 2B,5B of members 2 and 5 supporting the hinge.

It should be emphasized that in comparison with the previous embodiment this embodiment makes it possible to open the door through a wider angle.

I claim:

1. A hinge for a built-in electrical domestic appliance, for attaching at least one door to a body of the electrical domestic appliance, a facing panel being provided to cover the door, the facing panel forming part of an item of furniture in which the electrical domestic appliance is disposed, the hinge comprising:

a first support member including a first support member attachment wall attached to the body of the electrical domestic appliance;

a second support member including a second support member attachment wall attached to one of said door and said panel;

a first connecting bar connecting said first and second support member;

a second connecting bar connecting said first and second support member, said first connecting bar, said second connecting bar, said first support member and said second support member forming a hinged quadrilateral lying in one or more planes, perpendicular to said door, said hinged quadrilateral having quadrilateral sides defined by said first connecting bar, said second connecting bar, said first support member and said second support member wherein said sides are selected to define means for opening and closing said door and said facing panel without said door and without said facing panel interfering with a remainder of said item of furniture, said hinged quadrilateral means including a hinged connection of said first connecting bar to distal ends of first support and said second support and a hinge connection of said second connecting bar to distal ends of said first support and said second support, said first support attachment wall being substantially parallel to said second support attachment wall when said door and panel are in a closed position;

adjustment means forming part of said second support, said adjustment means for defining a position of the facing panel with respect to the door and for connecting said facing panel and said door, said adjustment means including at least one movable member, movable in parallel with said attachment wall of said second support member and guide means for guiding said movable member, said movable member having at least one attachment means for attaching said second support member to the facing panel; and a resilient member connected to one of said first connecting bar and said second connecting bar.

2. A hinge according to claim 1, wherein said movable member comprises a block including a first threaded through hole and a second through hole, said first threaded through hole and said second through hole being disposed perpendicular to each other, said guide means comprising at least one screw engaging said first threaded through hole and a plurality of holes provided in an opposing side wall of said second support member wherein said block is displaced along said screw when said screw is rotated, said attachment means comprising at least one screw which engages said second through hole.

3. A hinge according to claim 2, wherein said movable member is separable from said second support member, said movable member being useable in one of an inverted form and several times on different hinges.

4. A hinge according to claim 1, wherein said movable member comprises a block having a first through hole and a second through hole, said first and second through holes being perpendicular to each other, said guide means comprising a pin passing through said first hole for guiding said block, said pin being secured in holes provided in an opposite side wall of said second support member, said attachment means comprising at least one screw engaging said second through hole, said second through hole being in the form of an eyelet.

5. A hinge according to claim 1, wherein said resilient member is a leaf spring with one end anchored on a fulcrum provided on said first support member and with an opposite end hooked in to an intermediate part of one of said first connecting bar and said second connecting bar.

6. A hinge according to claim 1, wherein said first connecting bar is in a first connecting bar plane and said second connecting bar lies in a second connecting bar plane, said first connecting bar plane and said second connecting bar plane being parallel to each other, said first support member including a first support member sidewall and said second support member including a second support member sidewall, said first support member sidewall and said second support member sidewall being perpendicular to axes of rotation of said first connecting bar and said second connecting bar.

7. A hinge according to claim 1, wherein each of said first support member and said second support member includes side walls, said first connecting member and said second connecting member lying in planes which are perpendicular to said side walls, said side walls being perpendicular to axis of rotation of said first connecting bar and said second connecting bar.

8. A hinge according to claim 1, wherein said quadrilateral means includes:

a pin connecting said first connecting bar to said first support and a pin connecting said second connecting bar to said first support, said pins having a distance between centers of 17.1 plus or minus 0.5 mm;

a pin connecting said first connecting bar to said second support and a pin connecting said second connecting bar to said second support having a distance between centers of 9.1 plus or minus 0.5 mm, said pins of said first connecting bar being spaced a distance between centers of 83.4 plus or minus 0.5 mm and said pins of said second connecting bar having a distance between centers of 76.4 plus or minus 0.5 mm or measurements proportional to said distances.

* * * * *

UNITED STATES PATENT AND TRADEMARK OFFICE

CERTIFICATE OF CORRECTION

PATENT NO. : 5,471,709

DATED : December 5, 1995

INVENTOR(S) : LANZANI

It is certified that error appears in the above-indentified patent and that said Letters Patent is hereby corrected as shown below:

On the title page, item [75], change "Oresta" to --Oreste--;
item [73], delete "Angelo Bertasio" and change "all" to --both--.

Signed and Sealed this

Twenty-eighth Day of October, 1997

*Attest:*

Bruce Lehman

BRUCE LEHMAN

*Attesting Officer*

*Commissioner of Patents and Trademarks*